US007651447B2

(12) United States Patent
Yang

(10) Patent No.: US 7,651,447 B2
(45) Date of Patent: Jan. 26, 2010

(54) STRIKE TRAINER

(75) Inventor: Chui-Ching Yang, Shu-Lin (TW)

(73) Assignee: Chuang Yii Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 12/107,246

(22) Filed: Apr. 22, 2008

(65) Prior Publication Data

US 2009/0264263 A1 Oct. 22, 2009

(51) Int. Cl.
*A63B 69/34* (2006.01)

(52) U.S. Cl. ..... 482/85; 482/82

(58) Field of Classification Search ..... 482/83, 482/85–87, 90

See application file for complete search history.

(56) References Cited

U.S. PATENT DOCUMENTS

| | | | | | |
|---|---|---|---|---|---|
| 1,446,835 | A * | 2/1923 | Cook | 446/227 |
| 1,481,594 | A * | 1/1924 | Fitzgerald | 482/85 |
| 1,612,796 | A * | 1/1927 | Abraham | 482/90 |
| 1,733,709 | A * | 10/1929 | Zinnow et al. | 482/90 |
| 2,085,161 | A * | 6/1937 | Kraus | 482/90 |
| 2,184,453 | A | 12/1939 | Hayes | |
| 2,186,403 | A * | 1/1940 | Bullis et al. | 482/90 |
| 2,197,545 | A * | 4/1940 | Bachman et al. | 473/444 |
| 2,929,629 | A * | 3/1960 | Feula | 473/445 |
| 3,022,072 | A * | 2/1962 | Zinnow | 482/90 |
| 3,250,533 | A * | 5/1966 | Nicholson | 482/83 |
| 4,946,159 | A * | 8/1990 | Jones | 482/83 |
| 5,330,403 | A * | 7/1994 | Kuo | 482/83 |
| 5,389,057 | A * | 2/1995 | Zagata, Jr. | 482/83 |
| 5,624,358 | A * | 4/1997 | Hestilow | 482/90 |
| 5,899,835 | A * | 5/1999 | Puranda | 482/90 |
| 5,921,895 | A * | 7/1999 | Lynch et al. | 482/83 |
| 6,080,089 | A * | 6/2000 | Nicholson | 482/83 |
| 6,090,018 | A * | 7/2000 | Laudenslager et al. | 482/87 |
| 6,106,443 | A * | 8/2000 | Kuo | 482/83 |
| 6,110,079 | A * | 8/2000 | Luedke et al. | 482/83 |
| 6,183,399 | B1 * | 2/2001 | Chen | 482/90 |
| 6,251,051 | B1 * | 6/2001 | Chen | 482/83 |
| 6,390,958 | B1 * | 5/2002 | Chu | 482/90 |
| 6,464,621 | B1 * | 10/2002 | Chen | 482/83 |
| 6,790,167 | B1 * | 9/2004 | Carlin et al. | 482/90 |

(Continued)

FOREIGN PATENT DOCUMENTS

| | | |
|---|---|---|
| DE | 9317048 | 1/1994 |

(Continued)

*Primary Examiner*—Lori Baker
(74) *Attorney, Agent, or Firm*—Rabin & Berdo, P.C.

(57) ABSTRACT

A strike trainer has an attachment assembly, a shock absorber, a target mount and a target. The attachment assembly has an attachment body, an outer stabilizer being mounted on the attachment body, a metal sleeve being mounted through the attachment body and the outer stabilizer and an inner stabilizer being formed inside the metal sleeve. The shock absorber is connected to the metal sleeve of the attachment assembly. The target mount is mounted in the shock absorber and has an inner disk, an outer disk, a metal sleeve and a plastic tube being mounted inside the metal sleeve. The outer disk is mounted on an outer surface of the inner disk, the metal sleeve of the target mount is mounted through the inner and outer disks and the plastic tube is mounted in the metal sleeve. The target is mounted on the target mount.

9 Claims, 6 Drawing Sheets

U.S. PATENT DOCUMENTS

| | | | | |
|---|---|---|---|---|
| 7,086,997 | B1 * | 8/2006 | Fields et al. | 482/90 |
| 7,150,700 | B2 * | 12/2006 | MacKay et al. | 482/83 |
| 7,226,398 | B2 * | 6/2007 | Fu | 482/85 |
| 7,297,092 | B1 * | 11/2007 | Gaynor | 482/86 |
| 7,357,760 | B1 * | 4/2008 | Rios | 482/90 |
| 7,479,095 | B2 * | 1/2009 | Wang | 482/87 |
| 7,485,075 | B2 * | 2/2009 | Ghim | 482/83 |
| 2004/0152568 | A1 * | 8/2004 | Triani | 482/83 |
| 2004/0209743 | A1 * | 10/2004 | Perez | 482/83 |
| 2005/0266966 | A1 * | 12/2005 | Arrington | 482/83 |
| 2005/0288159 | A1 * | 12/2005 | Tackett | 482/84 |
| 2006/0019803 | A1 * | 1/2006 | Giaquinta et al. | 482/83 |
| 2006/0025285 | A1 * | 2/2006 | Giusti | 482/83 |
| 2006/0252608 | A1 * | 11/2006 | Kang et al. | 482/84 |
| 2006/0270529 | A1 * | 11/2006 | Fields et al. | 482/83 |
| 2007/0087911 | A1 * | 4/2007 | Ghim | 482/84 |
| 2007/0093362 | A1 * | 4/2007 | Clayton | 482/88 |
| 2007/0099771 | A1 * | 5/2007 | Fu | 482/83 |
| 2007/0117689 | A1 * | 5/2007 | MacKay et al. | 482/86 |
| 2007/0142186 | A1 * | 6/2007 | Macnab | 482/83 |
| 2007/0167297 | A1 * | 7/2007 | Stevenson | 482/83 |
| 2007/0197348 | A1 * | 8/2007 | Ku | 482/83 |
| 2008/0015093 | A1 * | 1/2008 | Helton | 482/83 |
| 2008/0125293 | A1 * | 5/2008 | Ng | 482/84 |
| 2008/0274862 | A1 * | 11/2008 | Wang | 482/87 |

FOREIGN PATENT DOCUMENTS

| | | |
|---|---|---|
| TW | 413072 | 11/2000 |

* cited by examiner

STRIKE TRAINER

BACKGROUND OF THE INVENTION

1. Field of the Invention

The present invention relates to a strike trainer, especially to a strike trainer that is durable and has a good shock absorption capacity.

2. Description of the Prior Arts

A strike trainer is an apparatus for training and can be used to practice punching, striking, kicking and batting. A conventional strike trainer has a base, a shock-absorbing element and a target. The shock-absorbing element is mounted on the base and has a default position. The target is mounted on the shock-absorbing element and may be a soft bag for hitting or a tee and ball, wherein the ball is placed on the tee and may be a baseball, soccer ball or the like. When a first, foot or bat strikes the target, the shock-absorbing element deforms and returns to the original position. Repeatedly striking the target is performed in martial art or boxing training, while use of the tee and ball as the target allows batting or kicking practice.

T.W. Application No.89200360 describes a strike trainer having a base, a resilient body and a target. The resilient body is mounted on the base using a connector. The target is mounted on the resilient body. When hitting the target, the resilient body bends relative to the base to absorb impact forces from the target.

The base of the foregoing conventional strike trainer may be metal or plastic. When the base is metal, material costs are expensive and the apparatus is heavy and not portable. When the base is plastic, the connector may break, or cause the base to break when the resilient body absorbs impact forces.

To overcome the shortcomings, the present invention provides a strike trainer to mitigate or obviate the aforementioned problems.

SUMMARY OF THE INVENTION

The main objective of the present invention is to provide a strike trainer that is durable and has a good shock absorption capacity.

The strike trainer in accordance with the present invention has an attachment assembly, a shock absorber, a target mount and a target. The attachment assembly has an attachment body, an outer stabilizer being mounted on the attachment body, a metal sleeve being mounted through the attachment body and the outer stabilizer and an inner stabilizer being formed inside the metal sleeve. The shock absorber is connected to the attachment assembly and has a spring being attached to the metal sleeve of the attachment assembly and a resilient assembly being mounted inside the spring and being mounted in the inner stabilizer of the attachment assembly. The target mount is mounted in the shock absorber and has an inner disk, an outer disk, a metal sleeve and a plastic tube. The outer disk is mounted on an outer surface of the inner disk, the metal sleeve of the target mount is mounted through the inner and outer disks and the plastic tube is mounted in the metal sleeve of the target mount. The target is mounted on the target mount. As assembled, the strike trainer is durable and provides good shock absorption.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
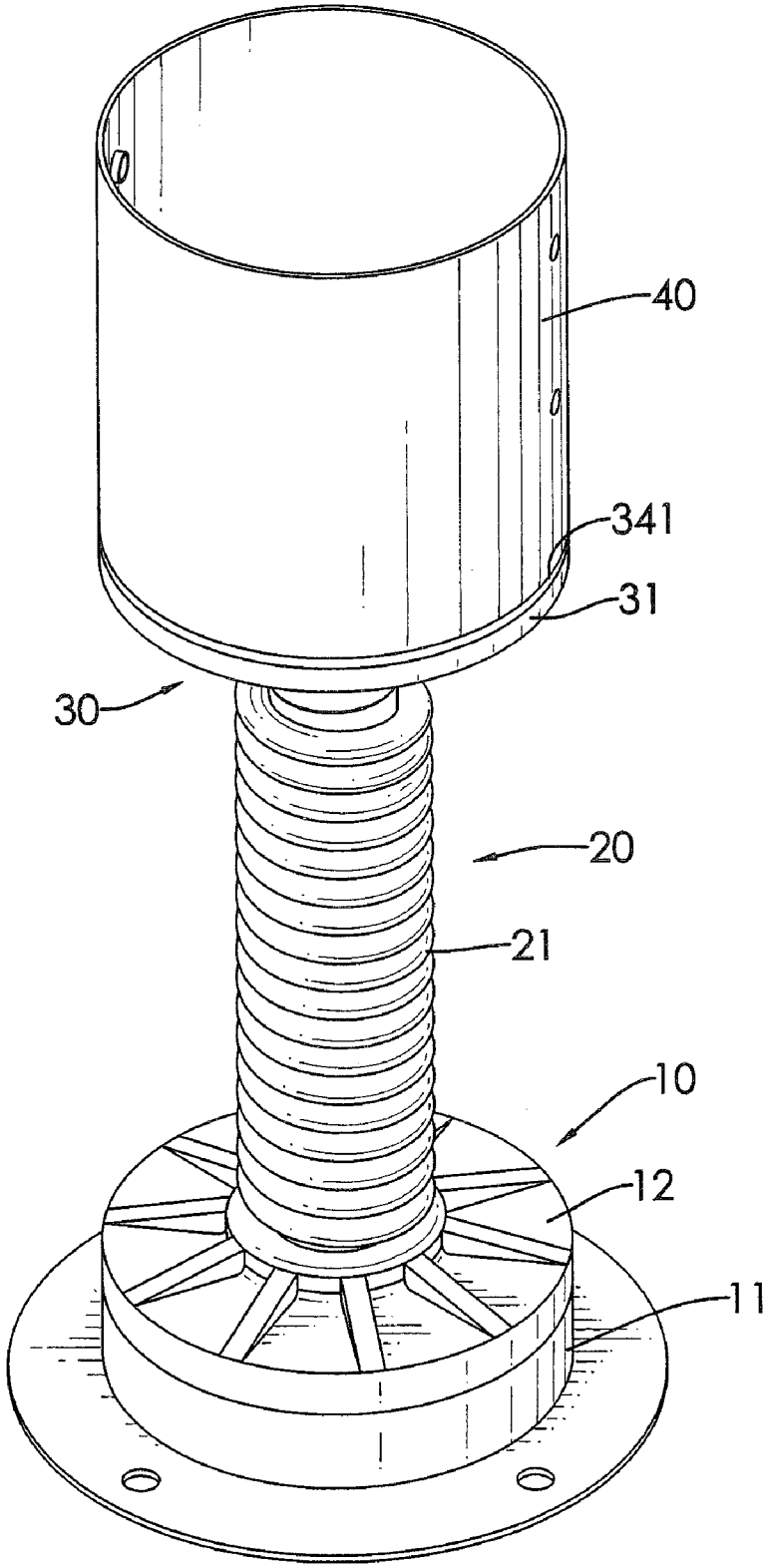
FIG. 1 is a perspective view of a first embodiment of a strike trainer in accordance with the present invention.
Figure 4:
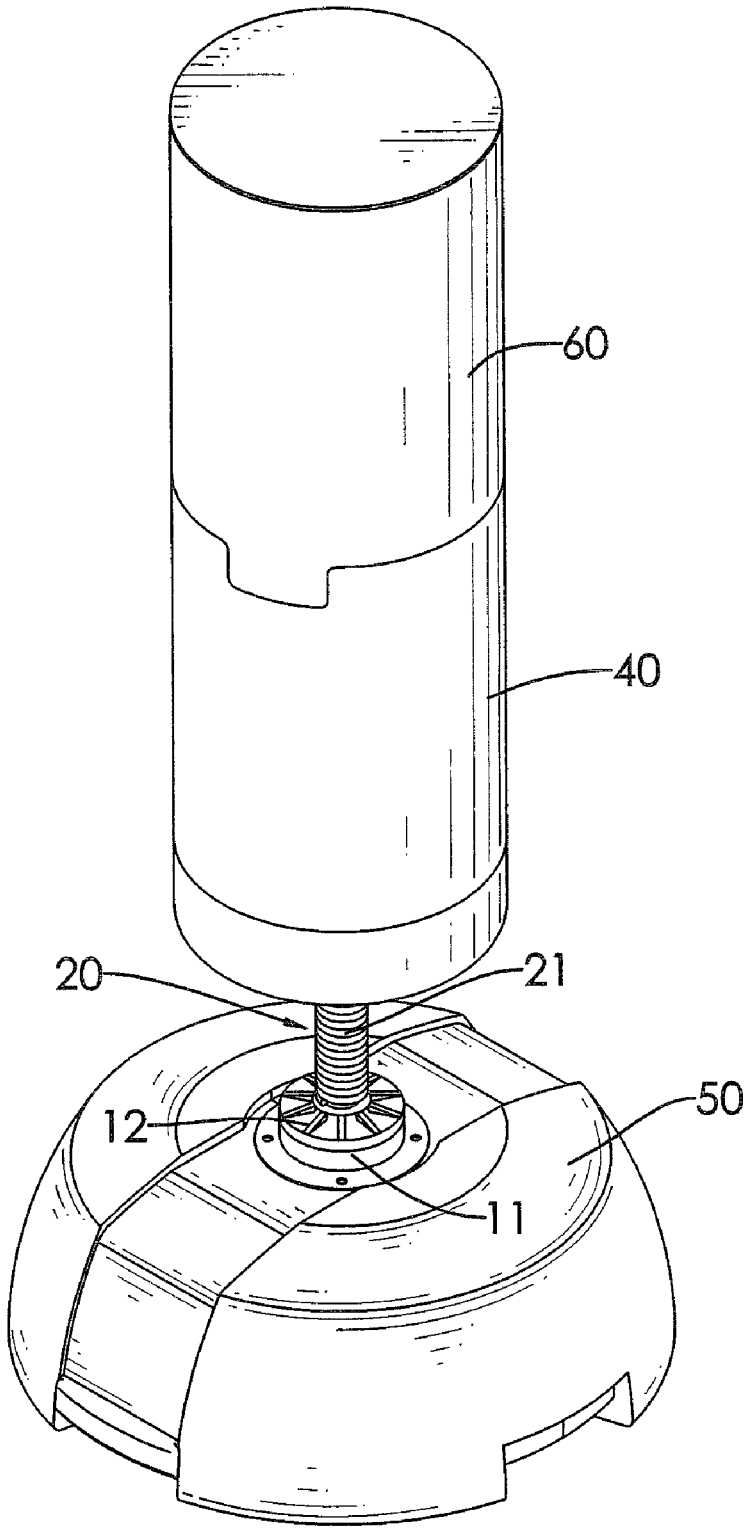
FIG. 4 is a perspective view of the strike trainer farther comprising a base and a punching bag.

With reference to FIGS. 1 and 4, a strike trainer in accordance with the present invention comprises an attachment assembly (10), a shock absorber (20), a target mount (30), a target (40) and may have a base (50).

Figure 2:
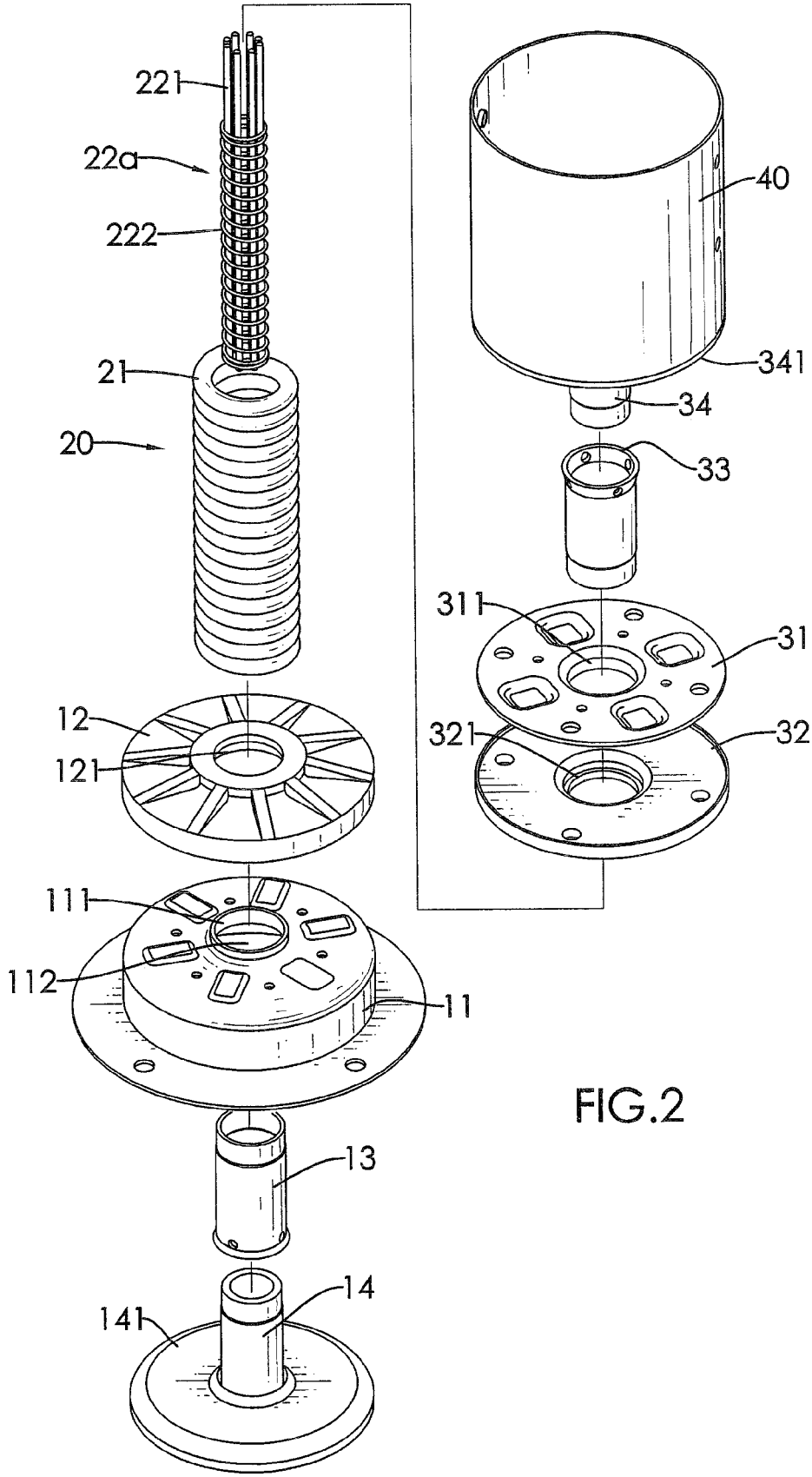
FIG. 2 is a partially exploded perspective view of the strike trainer in FIG. 1.
Figure 3:
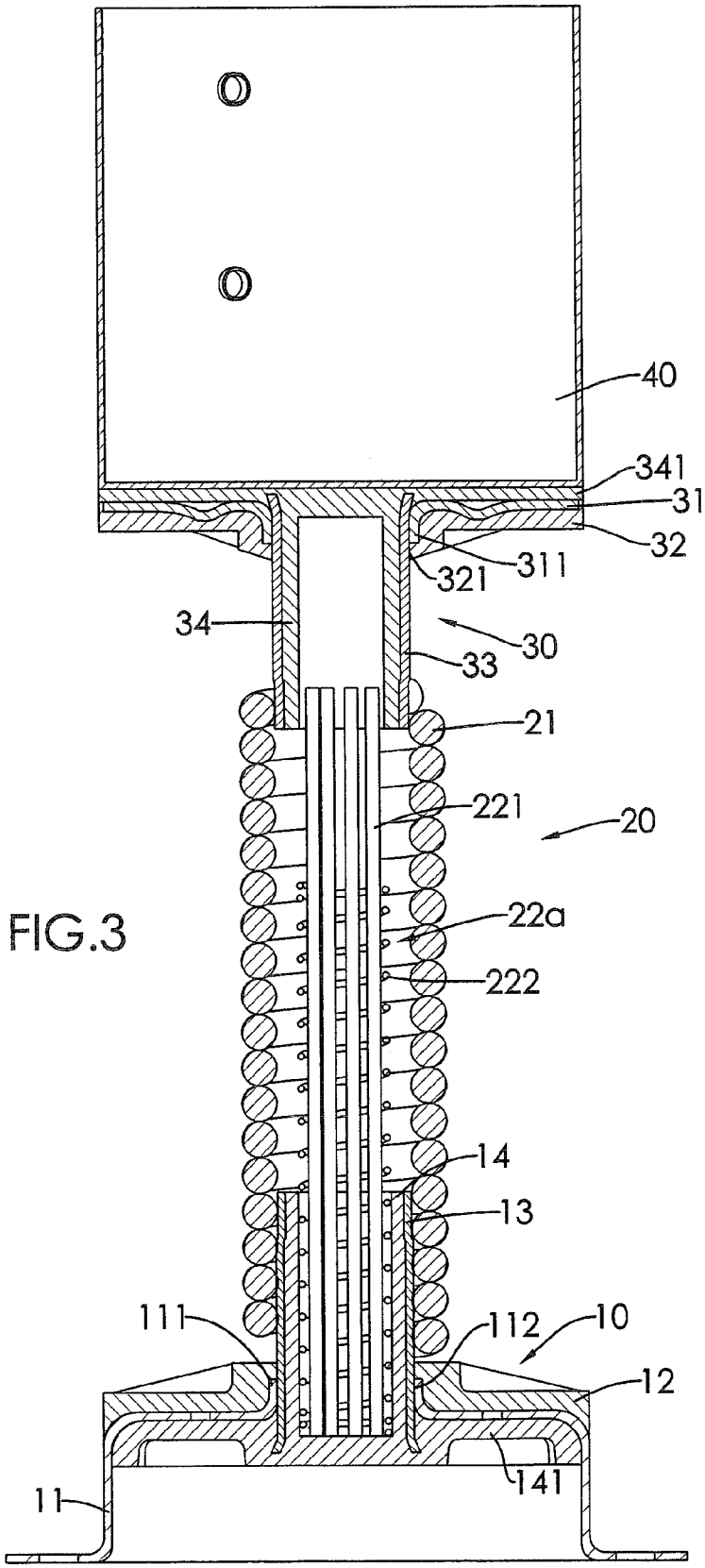
FIG. 3 is a side view in partial section of the strike trainer in FIG. 1.

With further reference to FIGS. 2 and 3, the attachment assembly (10) has an attachment body (11), an outer stabilizer (12), a metal sleeve (13), and an inner stabilizer (14). The attachment body (11) is formed of metal, is configured in a boater shape and has a flat crown (111), a flat brim for attachment to a plane and a central hole (112). The crown (111) has an inner surface. The central hole (112) is formed through the crown (111).

The outer stabilizer (12) is formed on the attachment body (11) by injection molding and may have a through hole (121). The through hole (121) is formed through the outer stabilizer (12) and corresponds to the central hole (112). The metal sleeve (13) is mounted through the attachment body (11) and outer stabilizer (12), may be mounted through the central hole (112) and the through hole (121), and has an inner surface.

The inner stabilizer (14) is plastic and formed on the inner surface of the metal sleeve (13) by injection molding and may have a proximal end and an extension disk (141). The extension disk (141) is formed on and protrudes from the proximal end, corresponds to and is mounted on the inner surface of the crown (111) of the attachment body (11).

The shock absorber (20) connects to the attachment assembly (10) and has a spring (21) and a resilient assembly (22). The spring (21) has a distal end and a proximal end. The distal end of the spring (21) is mounted around the metal sleeve (13).

Figure 5:
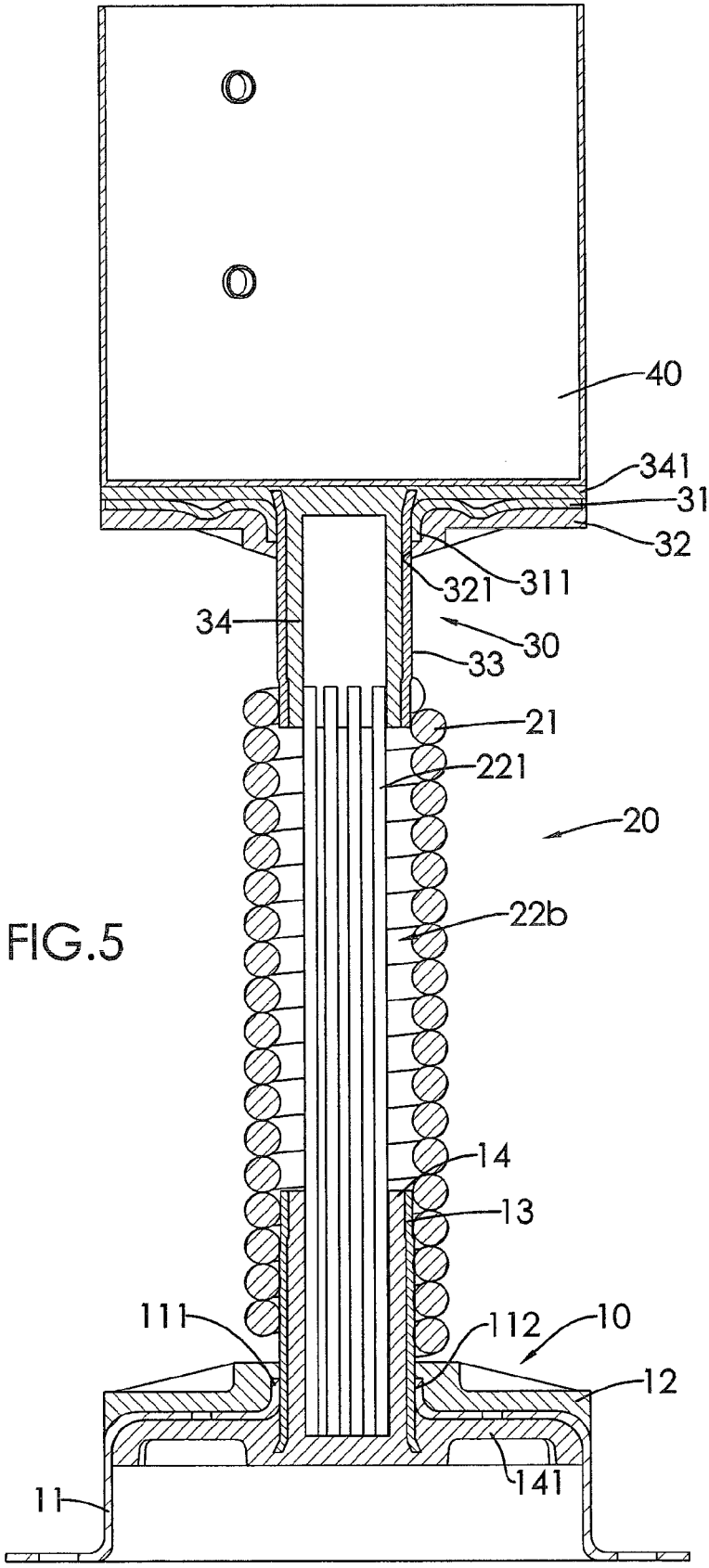
FIG. 5 is a side view in partial section of a second embodiment of the strike trainer in accordance with the present invention.
Figure 6:
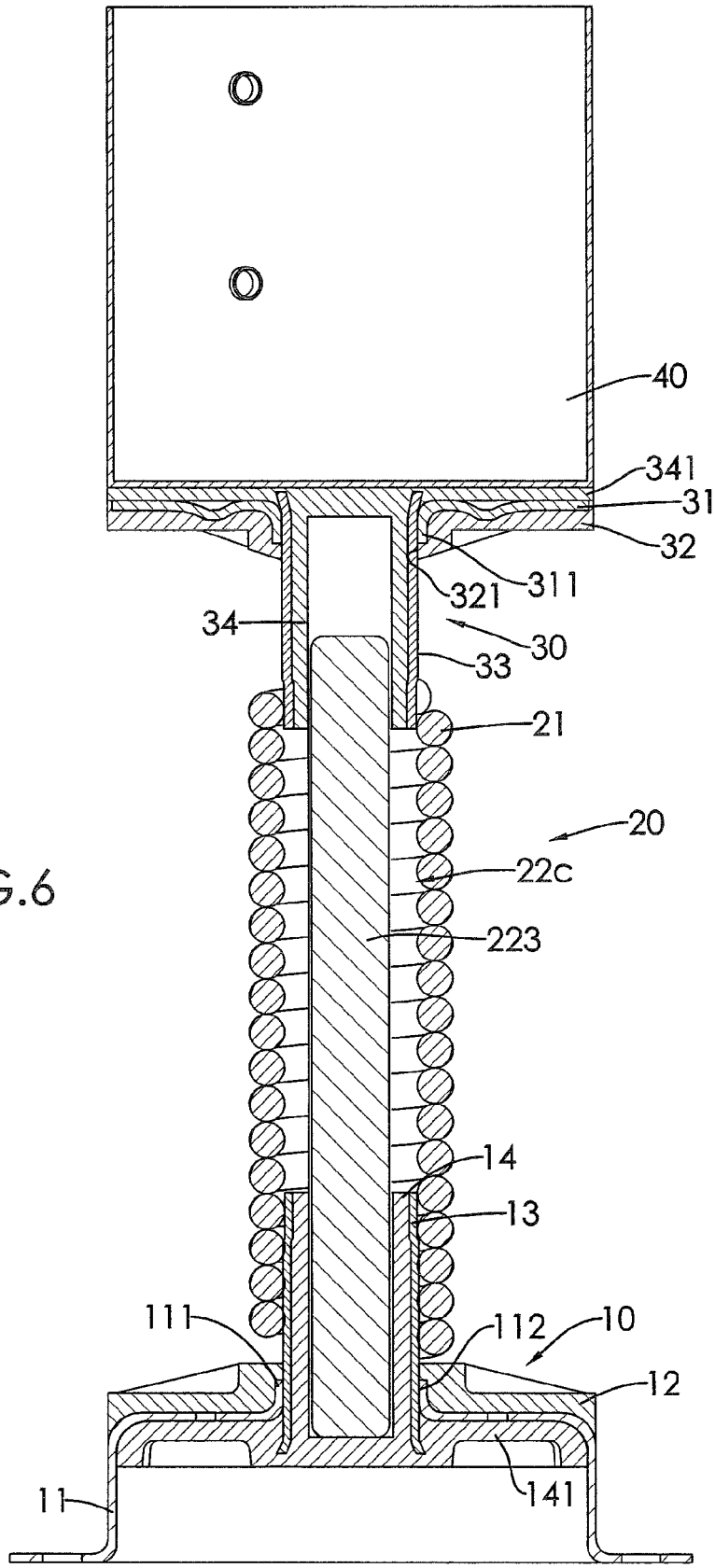
FIG. 6 is a side view in partial section of a third embodiment of the strike trainer in accordance with present invention.

With further reference to FIGS. 5 and 6, the resilient assembly (22*a*, 22*b*, 22*c*) is mounted inside the spring (21) and has a distal end and a proximal end and may be implemented by using multiple steel rods (221) held together with a spring line (222), multiple steel rods (221), or an elastomer (223). The proximal end of the resilient assembly (22*a*, 22*b*, 22*c*) is mounted in the inner stabilizer (14).

The target mount (30) is mounted in the distal end of the shock absorber and has an inner disk (31), and outer disk (32), a metal sleeve (33) and a plastic tube (34). The inner disk (31) is formed of metal, has an inner surface, an outer surface and may have a central hole (311). The central hole (311) of the inner disk (31) is formed through the inner disk (31). The outer disk (32) is formed of plastic material, on the outer surface of the inner disk (31) by injection molding and may have a through hole (321). The through hole (31) of the outer disk (32) is formed through the outer disk (32) and corresponds to the central hole (311) of the inner disk (31). The metal sleeve (33) of the target mount (30) is mounted through the inner and outer disks (31, 32), may be mounted through the central hole (311) of the inner disk (31) and the through hole (321) of the outer disk (32) and is mounted into the distal end of the spring (21) and has an inner surface. The plastic tube (34) is formed on the inner surface of the metal sleeve (33) of the target mount (30) by injection molding and mounted securely in the proximal end of the resilient assembly (22*a*, 22*b*, 22*c*) and may have an inner end and an extension disk (341). The extension disk (341) is integrally formed on and protrudes from the inner end of the plastic tube (34).

The target (40) is mounted on the target mount (30) and has an attachment end and an optional punch bag (60). The attachment end is mounted on the extension disk (341) of the plastic tube (34). A ball, such as a baseball, soccer ball or the like may be placed upon the target (40) for people to hit for batting or kicking practice. The punch bag (60) is mounted on the target (40) and is punched or kicked for martial arts training, boxing or the like.

The base (50) provides a stable platform for the attachment assembly (10) and is connected to the attachment body (11). To increase stability of the base, the base (50) can be filled with water or sand.

As the spring (21) mounted around the metal sleeve (13), mechanical stress formed between the spring (21) and the attachment assembly (10) and the target mount (30) and the spring (21) is respectively shared between the attachment body (11), outer stabilizer (12), metal sleeve (13), inner stabilizer (14) and extension disk (141) of the attachment assembly (10) and the inner disk (31), outer disk (32), metal sleeve (33) and plastic tube (34) of the target mount (30). Furthermore, the resilient assembly (22*a*, 22*b*, 22*c*) mounted inside the spring (21) increases energy absorbance capability of the shock absorber (20) to facilitate shock absorption. Thus the strike trainer is durable and has a long operational life span.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A strike trainer comprising:

an attachment assembly having a metal attachment body;

an outer stabilizer mounted on the attachment body;

a metal sleeve mounted through the attachment body and the outer stabilizer and having an inner surface; and a plastic inner stabilizer formed on the inner surface of the metal sleeve;

a shock absorber connected to the attachment assembly having a spring with a distal end mounted around the metal sleeve and a proximal end; and a resilient assembly mounted inside the spring having a distal end and a proximal end mounted in the inner stabilizer;

a target mount mounted in the distal end of the shock absorber having a metal inner disk having an inner surface and an outer surface;

a plastic outer disk formed on the outer surface of the inner disk;

a metal sleeve with an inner surface mounted in the distal end of the spring through the inner and outer disks of the target mount; and a plastic tube formed on the inner surface of the metal sleeve of the target mount and mounted securely in the proximal end of the resilient assembly; and a target mounted on the target mount and having an attachment end.

2. The strike trainer as claimed in claim 1, wherein the attachment body is configured in a boater shape and further has a flat crown having an inner surface; and a central hole being formed through the crown;

the outer stabilizer of the attachment assembly further has a through hole formed through the outer stabilizer and corresponding to the central hole of the attachment body of the attachment assembly; and the metal sleeve of the attachment assembly is mounted through the central hole of the attachment body of the attachment assembly and the through hole of the outer stabilizer of the attachment assembly; and the inner stabilizer further has a proximal end; and an extension disk integrally formed on and protruding from the proximal end of the inner stabilizer and mounted on the inner surface of the crown of the attachment body.

3. The strike trainer as claimed in claim 2, wherein the inner disk of the target mount further has a central hole formed through the inner disk;

the outer disk of the target mount further has a through hole formed through the outer disk of the target mount and corresponding to the central hole of the inner disk;

the metal sleeve of the target mount is mounted through the central hole of the inner disk and the through hole of the outer disk; and the plastic tube of the target mount further has an inner end and an extension disk integrally formed on and protruding from the inner end of the plastic tube.

4. The strike trainer as claimed in claim 1, wherein the strike trainer further has a base connected to the attachment body of the attachment assembly.

5. The strike trainer as claimed in claim 1, wherein the strike trainer further has a punch bag mounted on the target.

6. The strike trainer as claimed in claim 1, wherein the resilient assembly comprises multiple steel rods surrounded with a spring line.

7. The strike trainer as claimed in claim 1, wherein the resilient assembly comprises multiple steel rods.

8. The strike trainer as claimed in claim 1, wherein the resilient assembly comprises an elastomer.

9. The strike trainer as claimed in claim 1, wherein the inner stabilizer, the outer stabilizer, the outer disk and the plastic tube are injection molded.

* * * * *